US010272318B2

(12) United States Patent
Rupp et al.

(10) Patent No.: US 10,272,318 B2
(45) Date of Patent: Apr. 30, 2019

(54) SNOWSHOE

(71) Applicant: Quarry Trail, LLC, Salt Lake City, UT (US)

(72) Inventors: David Rupp, Salt Lake City, UT (US); Nicholas Hansen, Salt Lake City, UT (US)

(73) Assignee: QUARRY TRAIL, LLC, Salt Lake City, UT (US)

( * ) Notice: Subject to any disclaimer, the term of this patent is extended or adjusted under 35 U.S.C. 154(b) by 0 days.

(21) Appl. No.: 15/677,910

(22) Filed: Aug. 15, 2017

(65) Prior Publication Data

US 2018/0043234 A1 Feb. 15, 2018

Related U.S. Application Data

(60) Provisional application No. 62/375,182, filed on Aug. 15, 2016.

(51) Int. Cl.

| | |
|---|---|
| ***A63C 13/00*** | (2006.01) |
| ***A63C 5/12*** | (2006.01) |
| ***A63C 7/02*** | (2006.01) |
| ***A63C 10/06*** | (2012.01) |

(52) U.S. Cl.

CPC ..... *A63C 13/001* (2013.01); *A63C 5/128* (2013.01); *A63C 7/02* (2013.01); *A63C 10/06* (2013.01); *A63C 13/003* (2013.01); *A63C 13/006* (2013.01); *A63C 13/008* (2013.01); *A63C 2203/54* (2013.01)

(58) Field of Classification Search

CPC ... A63C 13/001; A63C 13/003; A63C 13/005; A63C 13/006; A63C 5/02; A63C 5/03; A63C 7/02; A63C 10/28

USPC ..... 36/125

See application file for complete search history.

(56) References Cited

U.S. PATENT DOCUMENTS

| | | | | |
|---|---|---|---|---|
| 5,033,765 | A * | 7/1991 | Cagneux | A63C 5/075 280/602 |
| 5,918,387 | A | 7/1999 | Emerson | |
| 6,349,961 | B1 | 2/2002 | Colley et al. | |
| 2003/0101622 | A1 | 6/2003 | Darnell | |
| 2007/0079529 | A1 | 4/2007 | Ekberg | |
| 2008/0174089 | A1 | 7/2008 | Ekberg | |
| 2008/0184599 | A1* | 8/2008 | Ekberg | A43B 5/0417 36/125 |
| 2011/0113651 | A1 | 5/2011 | Barchet | |
| 2012/0256395 | A1* | 10/2012 | Ritter | A63C 5/02 280/623 |
| 2016/0199722 | A1* | 7/2016 | Ritter | A63C 9/10 280/617 |

* cited by examiner

*Primary Examiner* — Ted Kavanaugh

(74) *Attorney, Agent, or Firm* — Kirton McConkie; Brian Tucker

(57) ABSTRACT

A snowshoe provides a way for outdoor enthusiasts to traverse the backcountry effectively and efficiently. The snowshoe allows the user to glide through the snow like a cross-country ski, but with the minimal footprint of a traditional snowshoe. The snowshoe includes a board and a binding mechanism that secures the user to the board, but allows for a pivoting motion. The pivoting motion allows the user to ascend steep terrain by performing a motion similar to cross-country skiing.

20 Claims, 6 Drawing Sheets

SNOWSHOE

CROSS-REFERENCE TO RELATED APPLICATIONS

This application claims priority to U.S. Provisional Patent Application No. 62/375,182 which was filed on Aug. 15, 2016.

BACKGROUND

Many outdoor enthusiasts enjoy snowboarding and skiing in fresh snow or "powder." At traditional ski resorts, the large crowds quickly track the powder after each snowstorm. To avoid the crowds and find fresh powder, some skier and snowboarders venture beyond the boundaries of the traditional resorts. This practice is commonly known as backcountry skiing or backcountry snowboarding.

Although the condition of the snow may be better in the backcountry, skiing and snowboarding in the backcountry comes with its own challenges. The backcountry lacks the chairlifts, gondolas, or trams that are used in traditional resorts to shuttle patrons to the top of the mountain. Without these forms of transportation, a backcountry skier or snowboarder must hike to the top of the mountain to enjoy the downhill ride in the powder. Heavy equipment and steep terrain can make the hike up the mountain challenging even in ideal conditions. The deep powder that draws skiers and snowboarders to the backcountry can further impede their progress up the slopes. Any individual attempting to hike up a mountain without specialized equipment will quickly sink into the deep powder halting their progress.

For skiers, this challenge has been overcome through the use of telemark skis with "ski skins" that can be attached to the bottom of each ski. The skins provide the requisite traction and the telemark skis include pivoting bindings which allow the user to glide up the mountain without sinking in the powder by performing a walking or skating movement. During the ascent, the pivoting bindings allow for free movement of the skier's heel, whereas during the descent the bindings can be locked into a fixed position to provide the necessary rigidity and stability. This equipment setup is advantageous because a skier must only bring ski skins in addition to their traditional gear.

Unlike skis, a snowboard's single board design requires users to remove their snowboard to hike the mountain. Consequently, a backcountry snowboarder must bring secondary equipment to aid in their trek up the slopes. Snowshoes are commonly used but lack the efficiency of telemark or cross country skies. Other snowboarders may opt for a pair of telemark or cross-country skies to aid in the ascent. However, the snowboarder must carry their snowboard on their back during the ascent and then carry their skies on their back during the descent. The weight of the secondary gear may become prohibitive. The added weight requires greater exertion which may exhaust a snowboarder quicker and limit their number of runs.

Splitboards have been developed to address these shortcomings (See e.g., U.S. Pat. Nos. 8,226,109 and 8,733,783). Splitboards allow for a snowboard to be separated longitudinally into two asymmetrical skis during the ascent and then be recombined into a snowboard during the descent. Although splitboards are an improvement over carrying an additional pair of snowshoes or telemark skis, they have their own drawbacks. For example, the process of separating and recombining the splitboard can be difficult. During the ascent, ice may form on the latching mechanism that combines the boards. Furthermore, snowboarders wear heavy gear and gloves that may further complicate the process of aligning the intricate pieces and combining the two skis. In addition, the asymmetrical shape of each ski differs from a traditional ski. The large and irregular shapes complicate the process of finding skins for each asymmetrical ski. The performance of a splitboard is also compromised in comparison to a traditional snowboard. Finally, the cost of a splitboard may be prohibitive.

BRIEF SUMMARY

The present invention extends to a snowshoe that provides a way for outdoor enthusiasts to traverse the back country effectively and efficiently. The length of the snowshoe may be shorter than a traditional cross-country ski while the width is generally wider than a traditional cross-country ski. The overall footprint of the snowshoe is similar to a traditional snowshoe, but the material may be rigid unlike the flexible netting of a traditional snowshoe. The snowshoe allows the user to glide through the snow like a cross-country ski but with the minimal footprint of a snowshoe.

In some embodiments, the snowshoe of the present invention comprises a board with a substantially horizontal section and an inclined section, and a binding mechanism that secures the user to the board but allows for a pivoting motion. In some embodiments, the binding mechanism secures the user to the board through the use of a ratcheting mechanism that can be variably tightened to fit the user's specific boot size. The ratcheting mechanism may also allow for rapid unfastening. In some embodiments, the binding mechanism pivots near the user's toe which substantially maintains the location of the user's toe but allows for vertical movement near the user's heel. In some embodiments, traction is maintained between the board and snow through the use of a skin. In some embodiments, the board is substantially rigid.

In some embodiments, the snowshoe of the present invention comprises a board that dissipates the user's weight over the snow surface and a binding mechanism that secures the user to the board. The interface between the board and the binding mechanism is configured to allow movement of the user's heel. In some embodiments, the user is secured to the board using one or more ratchetable straps to maintain the horizontal location of the user's heel. In some embodiments, the ratchetable straps can be quickly unfastened. In some embodiments, the binding mechanism pivots near the user's toe which substantially maintains the location of the user's toe but allows for vertical movement near the user's heel. In some embodiments, traction is maintained between the board and snow through the use of a skin. In some embodiments, the board is substantially rigid.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

The objects and features of the present invention will become more fully apparent from the following description, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which.

DETAILED DESCRIPTION

FIGS. 1-4 each depict a snowshoe 100 in accordance with one or more embodiments of the present invention. Snowshoe 100 allows a user to easily and efficiently traverse through the snow. Snowshoe 100 is constructed of a light weight material with a compact size to allow for easy storage when not in use. Snowshoe 100 prevents a user from sinking into the snow and allows the user to slide through the snow by performing a skating or walking motion.

In some embodiments, snowshoe 100 may be designed specifically to attach to a user's existing snowboard boots or any other type of snow boot. In other words, snowshoe 100 does not require the use of a boot that is customized for specific bindings.

Figure 1:
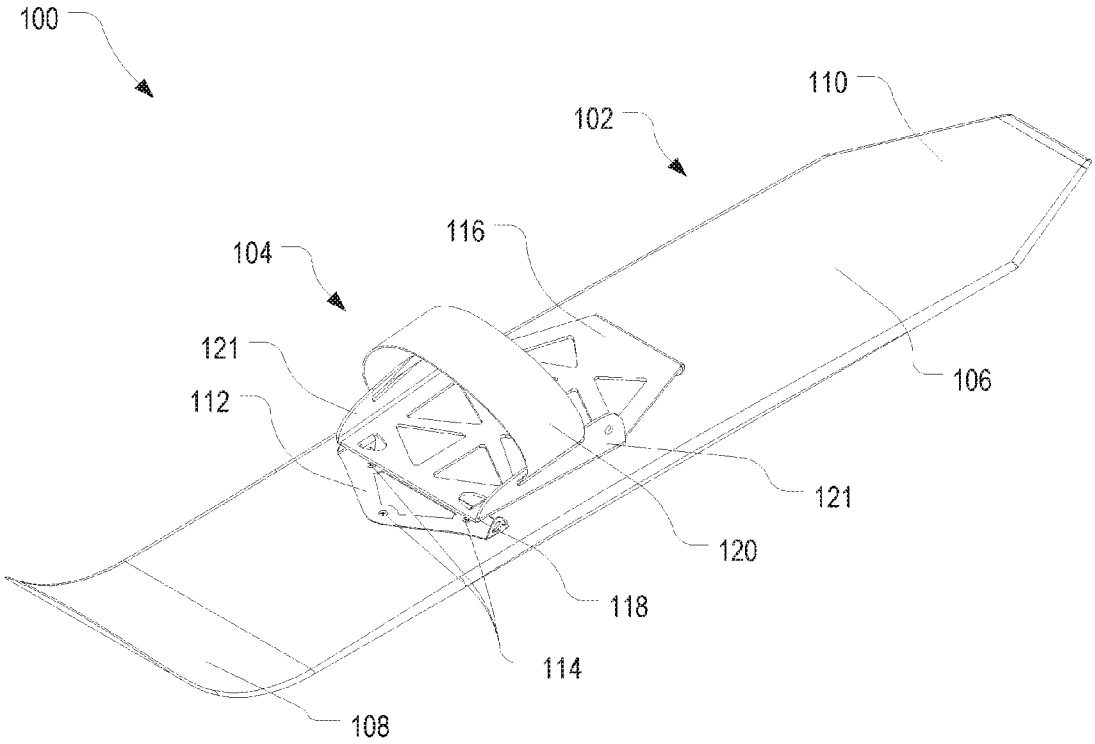
FIG. 1 is a top perspective view of a snowshoe in accordance with one or more embodiments of the present invention.

FIG. 1 depicts a perspective view of snowshoe 100 in accordance with one or more embodiments of the present invention. Snowshoe 100 comprises a board 102 and a binding mechanism 104 that provides an interface between the user's boot (not pictured) and board 102.

Although it could be configured in any reasonable size, snowshoe 100 may preferably be configured so that the length of board 102 ranges from 15 inches to 36 inches and the width of board 102 ranges from 5 inches to 10 inches. For example, an embodiment of board 102 may be 34.75 inches long by 6.75 inches wide. In such an embodiment, a distance from the rear edge of board 102 to the commencement of the curve (as described below) may be approximately 28.75 inches.

Board 102 can be constructed of a supportable, yet flexible material. For example, board 102 may comprise a wooden core and one or more composite exterior layers. Board 102 may also be made of a plastic material. As shown, board 102 forms a continuous surface on top of which the user's boot can be placed. In other words, there is no hole in board 102 through which the user's boot would pivot as is the case with traditional snowshoes.

In some embodiments, board 102 is substantially planar. As shown in the figures, board 102 can have an upward sloping front 108 and a tapered back 110. Upward sloping front 108 may be utilized to allow snowshoe 100 to glide through the snow rather than digging into the snow. A tapered back 110 may reduce drag and improve efficiency. In some embodiments, the back of the board (e.g., tapered back 110) may also slope upward similar to upward sloping front 108.

Binding mechanism 104 is configured to pivot to allow the user to glide over the snow by performing a skating or walking motion. Binding mechanism 104 comprises a mounting bracket 112 which secures binding mechanism 104 to board 102, a boot support plate 116, a hinging mechanism 118 that couples boot support plate 116 to mounting bracket 112, and a vertical securing mechanism 120 that is configured to maintain contact between the user's boot and boot support plate 116. In some embodiments, mounting bracket 112 may be attached to board 102 through the use of a fastener 114. In some embodiments, fastener 114 may be a glue, epoxy, screw, nail, bolt, rivet or combination thereof.

Hinging mechanism 118 forms a pivot point to allow boot support plate 116 to rotate with respect to board 102. In some embodiments, hinging mechanism 118 may be a traditional hinge. In other embodiments, hinging mechanism 118 may be a pin at the interface between boot support plate 116 and mounting bracket 112.

Boot support plate 116 may be configured with vertical returns 121 that maintain the lateral stability of the user's boot. One or more vertical securing mechanisms 120 may connect to boot support plate 116 at vertical returns 121 and function to secure the user's boot to boot support plate 116. Vertical securing mechanism(s) 120 may substantially restrict the vertical movement of the users boot with respect to boot support plate 116, and vertical returns 121 on boot support plate 116 may substantially restrict the lateral movement of the users boot with respect to boot support plate 116.

In some embodiments, such as is depicted in the figures, vertical securing mechanism(s) 120 may be a toe strap formed of a fabric and/or plastic material. In such embodiments, the toe strap may include hook and loop fasteners or similar material to secure the users boot to boot support plate 116. The hook and loop fasteners can allow the user to secure his or her boots tightly within vertical securing mechanism(s) 120. Other types of fasteners may equally be employed. For example, vertical securing mechanism(s) 120 could comprise one or more plastic straps that may be ratcheted to fit the user's boot size.

Figure 2A:
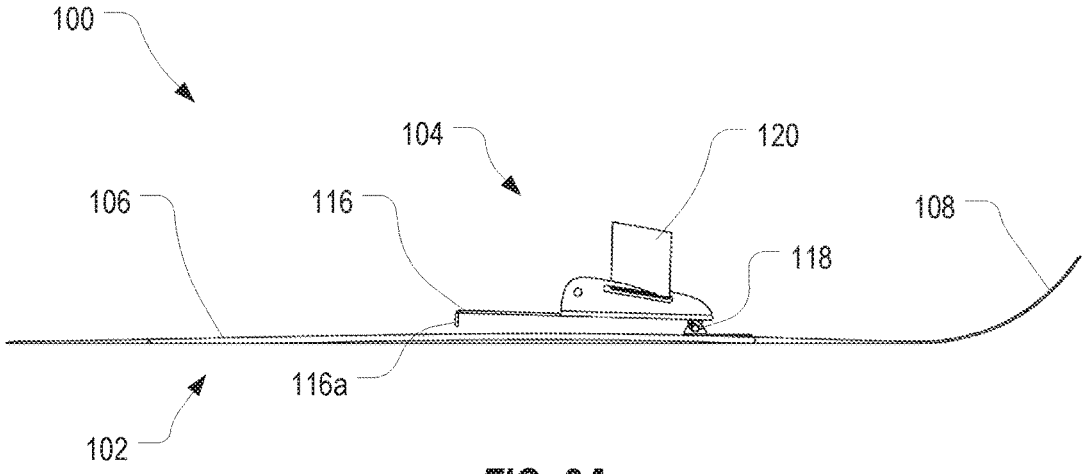
FIG. 2A is a left side view of the snowshoe of FIG. 1 with the binding mechanism in a horizontal position.
Figure 2B:
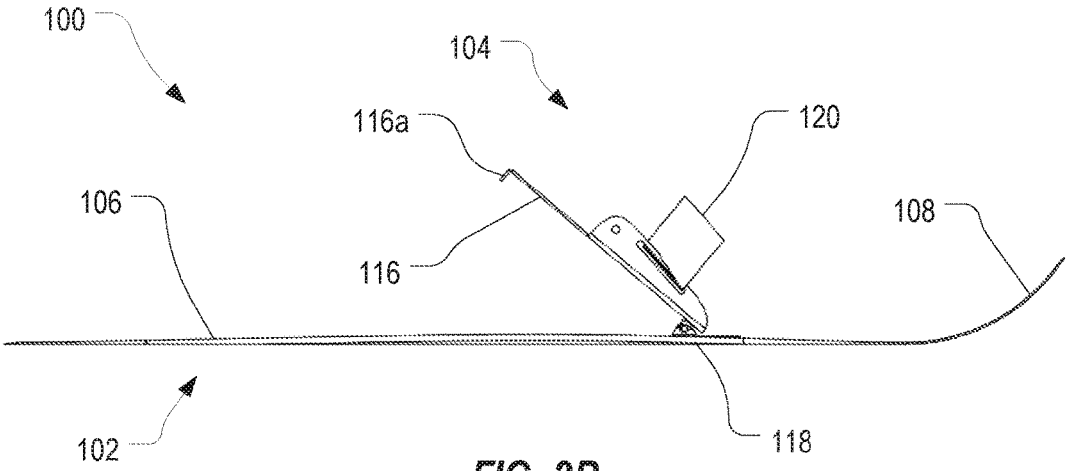
FIG. 2B is a left side view of the snowshoe of FIG. 1 with the binding mechanism in an elevated position.

FIGS. 2A and 2B depict a side view of snowshoe 100 in accordance with one or more embodiments of the present invention. In some embodiments, the thickness of board 102 may vary along the length of the board. For example, as shown in FIGS. 2A and 2B, the thickness of board 102 is greatest near the center of the length (i.e., underneath binding mechanism 104) and tapers towards the front and back of the board. The variable thickness of board 102 provides stability in critical locations while minimizing the weight. The variable thickness of the board may also provide the requisite flexibility to ensure that the user can efficiently glide through the snow.

In some embodiments, boot support plate 116 may have a heel riser **116*a* near the back of boot support plate 116. Heel riser 116*a* may limit the rotation of boot support plate 116 so that boot support plate 116 will not rotate below a parallel position to board 102**. This may improve durability, efficiency or user comfort.

FIG. 2A depicts boot support plate 116 in a horizontal position with respect to board 102. The horizontal position is commonly associated with the leading foot when using snowshoe 100. FIG. 2B depicts boot support plate 116 with the heel elevated with respect to board 102. The elevated heel position is commonly associated with the trailing foot when using snowshoe 100. Boot support plate 116 may freely rotate between the horizontal position and the elevated position to facilitate ascending a mountain.

Figure 3A:
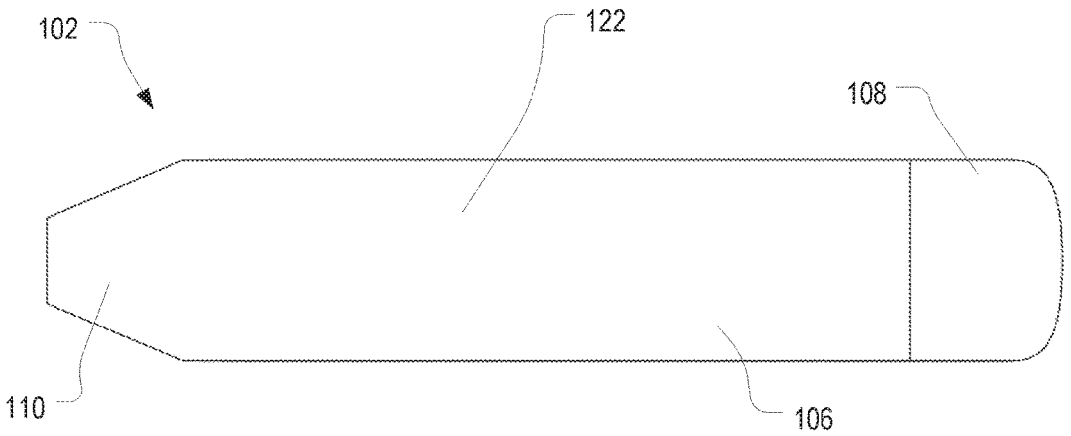
FIG. 3A is a bottom view of the snowshoe of FIG. 1.
Figure 3B:
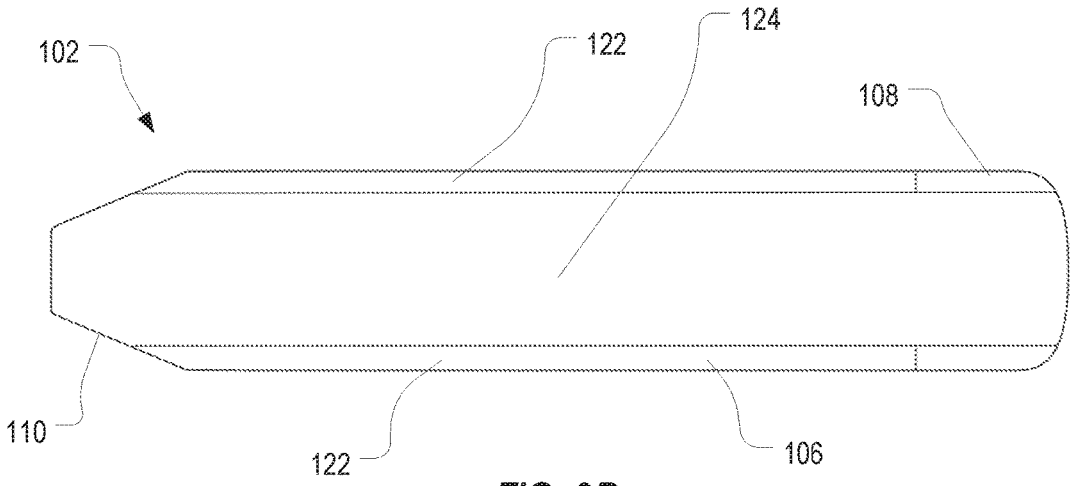
FIG. 3B is a bottom view of the snowshoe of FIG. 1 with a skin attached to the bottom of the snowshoe.

FIG. 3A depicts a bottom view of board 102 in accordance with one or more embodiments of snowshoe 100. The bottom of board 102 may include a smooth outer layer 122 that allows board 102 to glide over the surface of the snow. In contrast, FIG. 3B depicts the bottom view of board 102 after smooth bottom layer 122 of board 102 has been covered with a skin 124. Skin 124 provides the requisite friction to allow the user to ascend the mountain slopes. The user may select a skin material based on the desired traction, glide, durability and cost. In some embodiments, the skins are made of nylon or mohair. In some embodiments, snowshoe 100 may have a fixed or permanent skin 124. Such skins may be coupled to or incorporated into the bottom surface of board 102 in a permanent or semi-permanent fashion.

Figure 4:
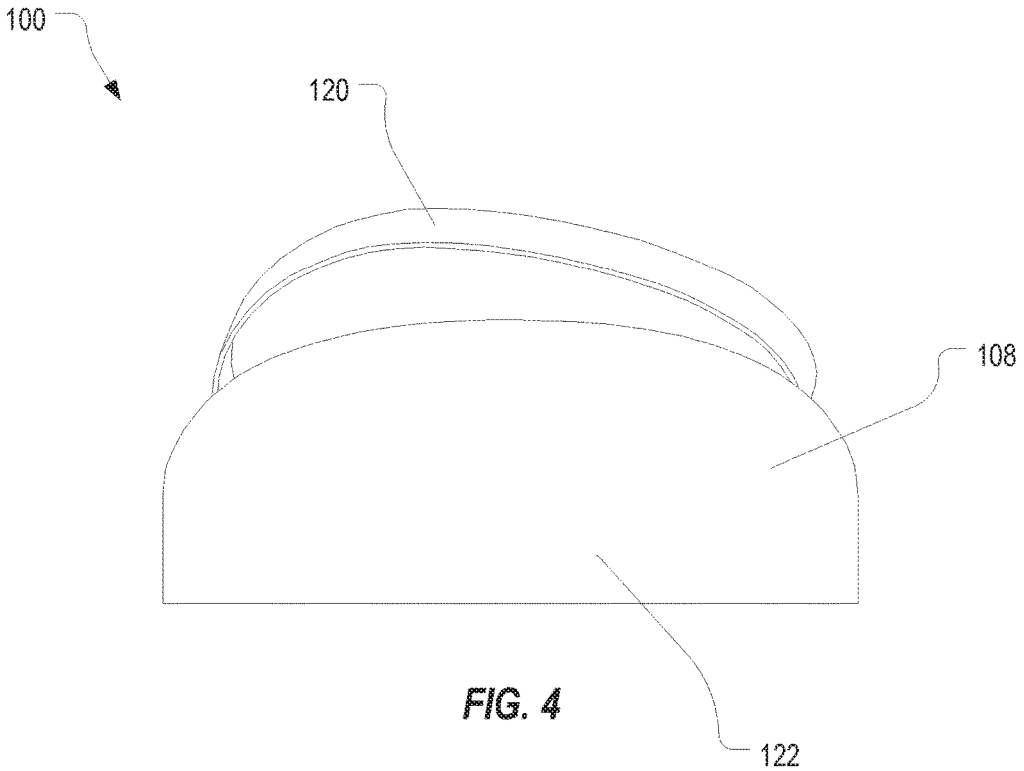
FIG. 4 is a front view of the snowshoe of FIG. 1.

FIG. 4 depicts a front view of snowshoe 100 in accordance with one or more embodiments of the present invention. As shown, upward sloping front 108 of board 102 may be arched. In some embodiments, back 110 of board 102 may have a similar design to upward sloping front 108.

Figure 5A:
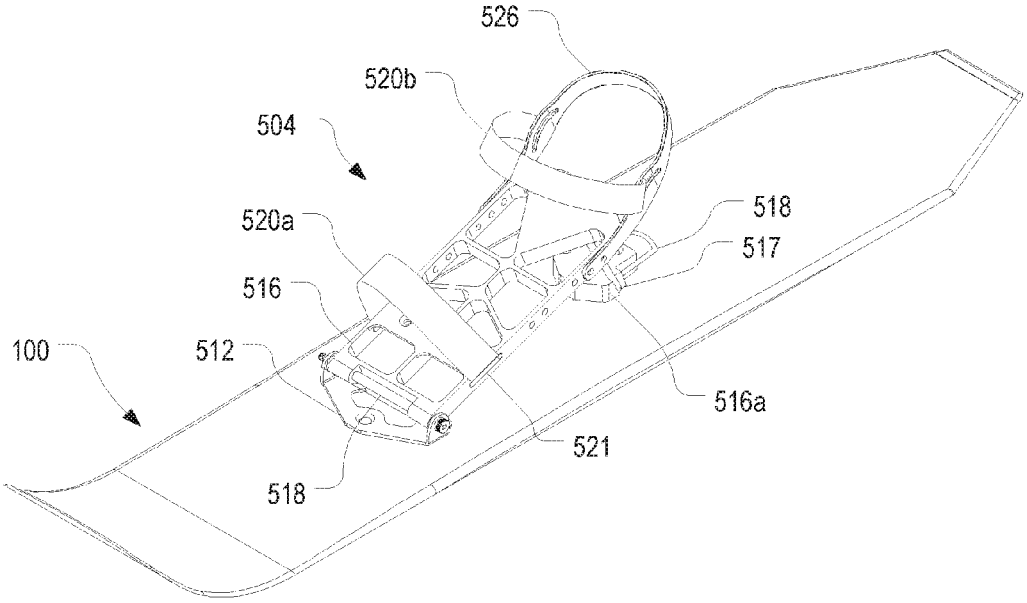
FIGS. 5A and 5B illustrate a snowshoe with another binding mechanism.
Figure 5B:
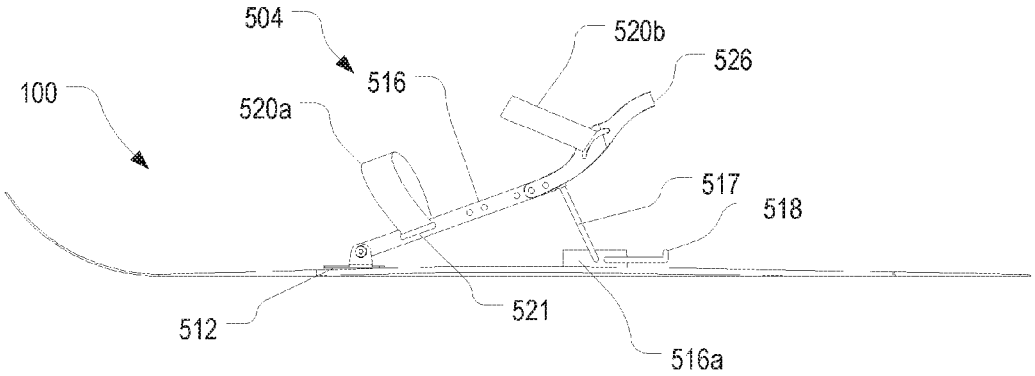

FIGS. 5A and 5B illustrate snowshoe with another embodiment of a binding mechanism 504. Binding mechanism 504 is structurally similar to binding mechanism 104. In particular, binding mechanism 504 comprises a boot support plate 516 that is connected to a mounting bracket 512 via hinging mechanism 518. Boot support plate 516 includes openings 521 on opposing sides by which a vertical securing mechanism 520*a* is coupled to the boot support plate. Openings 521 are positioned so that vertical securing mechanism 520*a* will be above the toe region of the user's boot. A heel strap 526 is coupled to the back end of boot support plate 516 and functions to prevent the user's boot from sliding backward out of binding mechanism 504. A second vertical securing mechanism 520*b* can extend from opposing sides of heel strap 526 so that it is positioned towards the ankle region of the user's boot. Vertical securing mechanisms 520*a*, 520*b* can be adjustable to accommodate boots/users of different sizes.

Figure 6A:
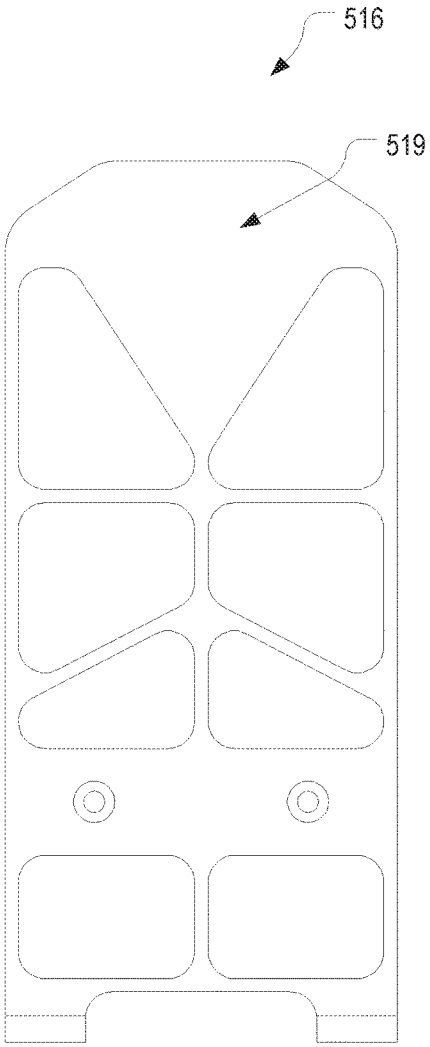
FIGS. 6A and 6B illustrate a boot support plate of the binding mechanism of FIGS. 5A and 5B.
Figure 6B:
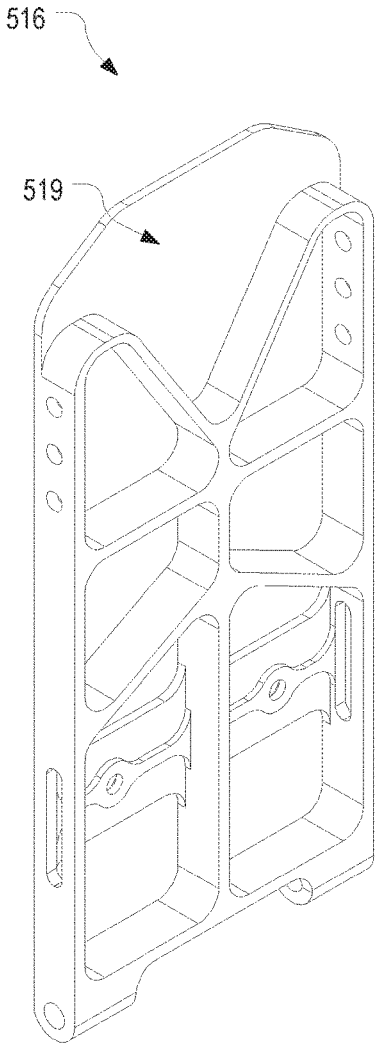

Binding mechanism 504 also includes a heel riser structure 516*a* that is secured to board 102 below the back end of boot support plate 516. Heel riser structure 516*a* can include two or more risers 517, 518 of different lengths to allow the user's heel to be supported at different heights. More specifically, each of risers 517, 518 can be configured to pivot between a vertical position and a horizontal position. In the vertical position (e.g., in the position of riser 517 in FIGS. 5A and 5B), the riser will contact the underside 519 (see FIGS. 6A and 6B which show boot support plate 516 in isolation) of boot support plate 516 to retain the back end of boot support plate 516 elevated above board 102. The user can select to use no riser, riser 517, or riser 518 to retain an elevation of boot support plate 516 that is desired for a particular terrain. Although heel riser structure 516*a* is shown as including two risers 517, 518, in some embodiments, a heel riser structure could include one riser or more than two risers.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A snowshoe comprising:

a board having a top and bottom surface, the top surface including a continuous portion in which no openings exist through the board, the bottom surface also including a continuous portion in which no openings exist through the board;

a binding mechanism that secures a user's boot to the board, the binding mechanism including a boot support plate that is positioned overtop the continuous portion of the top surface, the boot support plate having a front end that is coupled to the continuous portion of the top surface of the board via a hinging mechanism and a back end that is free to pivot away from the top surface of the board thereby allowing a heel of the user's boot to be lifted away from the top surface of the board when the user's boot is secured to the boot support plate, the hinging mechanism causing the boot support plate to remain fully above the continuous portion of the top surface of the board while the back end of the boot support plate pivots such that a toe of the user's boot remains above the top surface, the binding mechanism further including a heel riser structure that includes two or more risers each of which has a different length to thereby allow the back end of the boot support plate to be selectively supported at different heights; and a skin that at least partially covers the continuous portion of the bottom surface of the board.

2. The snowshoe of claim 1, wherein the binding mechanism further comprises a mounting bracket coupled to the continuous portion of the top surface of the board, the front end of the boot support plate being coupled to the mounting bracket via the hinging mechanism, the binding mechanism further comprising one or more securing mechanisms that maintain contact between the user's boot and the boot support plate.

3. The snowshoe of claim 2, wherein the board has a substantially horizontal section on which the continuous portions of the top and bottom surfaces are formed, an upwardly sloping front end, and a tapered rear end.

4. The snowshoe of claim 3, wherein each of the two or more risers pivots between a horizontal position and a vertical position.

5. The snowshoe of claim 4, wherein the boot support plate includes a first vertical securing mechanism that extends from opposing sides of the boot support plate.

6. The snowshoe of claim 5, wherein the boot support plate includes a heel strap that is coupled to the back end of the boot support plate and a second vertical securing mechanism that extends from opposing sides of the heel strap.

7. The snowshoe of claim 1, wherein the board is rigid and planar.

8. The snowshoe of claim 1, wherein the board has a substantially horizontal section on which the continuous portions of the top and bottom surfaces are formed, an upwardly sloping front end, and a tapered rear end.

9. The snowshoe of claim 1, wherein the board is constructed of a wooden core and composite exterior layers.

10. The snowshoe of claim 1, wherein each of the two or more risers pivots between a horizontal position and a vertical position.

11. The snowshoe of claim 1, wherein the boot support plate includes a first vertical securing mechanism that extends from opposing sides of the boot support plate.

12. The snowshoe of claim 11, wherein the boot support plate includes a heel strap that is coupled to the back end of the boot support plate and a second vertical securing mechanism that extends from opposing sides of the heel strap.

13. A snowshoe comprising:

a board that dissipates the user's weight over a snow surface, the top surface including a continuous portion in which no openings exist through the board, the bottom surface also including a continuous portion in which no openings exist through the board; and a binding mechanism that secures the user to the board, the binding mechanism including a boot support plate that is positioned overtop the continuous portion of the top surface, the boot support plate having a front end that is coupled to the continuous portion of the top surface of the board via a hinging mechanism and a back end that is free to pivot away from the top surface of the board thereby allowing a heel of the user's boot to be lifted away from the top surface of the board when the user's boot is secured to the boot support plate, the hinging mechanism causing the boot support plate to remain fully above the continuous portion of the top surface of the board while the back end of the boot support plate pivots such that a toe of the user's boot remains above the top surface, the binding mechanism further including a heel riser structure that includes two or more risers each of which has a different length to thereby allow the back end of the boot support plate to be selectively supported at different heights.

14. The snowshoe of claim 13, wherein the binding mechanism further comprises a mounting bracket coupled to the continuous portion of the top surface of the board, the front end of the boot support plate being coupled to the mounting bracket via the hinging mechanism, the binding mechanism further comprising one or more securing mechanisms that maintain contact between the user's boot and the boot support plate.

15. The snowshoe of claim 13, wherein the board is rigid and planar.

16. The snowshoe of claim 13, wherein the board has a substantially horizontal section on which the continuous portions of the top and bottom surfaces are formed, an upwardly sloping front end, and a tapered rear end.

17. The snowshoe of claim 13, wherein the board is constructed of a wooden core and composite exterior layers.

18. The snowshoe of claim 13, further comprising, a skin that at least partially covers the continuos portion of the bottom surface of the board.

19. A pair of snowshoes, each snowshoe comprising:

a board having a top and bottom surface that extend along a length and a width of the board, the length of the board being less than 36 inches, the width of the board being greater than 5 inches, the top surface including a continuous portion in which no openings exist through the board, the bottom surface also including a continuous portion in which no openings exist through the board;

a binding mechanism that secures a user's boot to the board, the binding mechanism including a boot support plate that is positioned overtop the continuous portion of the top surface, the boot support plate having a front end that is coupled to the continuous portion of the top surface of the board via a hinging mechanism and a back end that is free to pivot away from the top surface of the board thereby allowing a heel of the user's boot to be lifted away from the top surface of the board when the user's boot is secured to the boot support plate, the hinging mechanism causing the boot support plate to remain fully above the continuous portion of the top surface of the board while the back end of the boot support plate pivots such that a toe of the user's boot remains above the top surface; and a skin that at least partially covers the continuous portion of the bottom surface of the board.

20. The pair of snowshoes of claim 19, wherein the width of the board of each snowshoe is greater than six inches.

* * * * *